United States Patent [19]

Paquin et al.

[11] 4,359,597

[45] * Nov. 16, 1982

[54] TWISTED PAIR MULTI-CONDUCTOR RIBBON CABLE WITH INTERMITTENT STRAIGHT SECTIONS

[75] Inventors: Patrick J. Paquin, Hamden, Conn.; Donald D. Lang, Garden Grove, Calif.

[73] Assignee: Eltra Corporation, Toledo, Ohio

[ * ] Notice: The portion of the term of this patent subsequent to Jul. 5, 1994, has been disclaimed.

[21] Appl. No.: 65,555

[22] Filed: Aug. 10, 1979

Related U.S. Application Data

[60] Continuation of Ser. No. 885,440, Mar. 10, 1978, abandoned, which is a division of Ser. No. 725,539, Sep. 22, 1976, Pat. No. 4,096,006.

[51] Int. Cl.[3] ..... H01B 11/04

[52] U.S. Cl. ..... 174/34; 174/117 F

[58] Field of Search ..... 174/34, 117 F

[56] References Cited

U.S. PATENT DOCUMENTS

| | | | |
|---|---|---|---|
| 3,459,878 | 8/1969 | Gressitt | 174/117 R X |
| 3,736,366 | 5/1973 | Wittenberg | 174/34 |
| 3,833,755 | 9/1974 | Soelberg | 174/117 F |
| 4,012,577 | 3/1977 | Lang | 174/34 X |
| 4,034,148 | 7/1977 | Lang | 174/117 F X |

FOREIGN PATENT DOCUMENTS

| | | | |
|---|---|---|---|
| 2709129 | 8/1978 | Fed. Rep. of Germany | 174/117 F |

*Primary Examiner*—Richard R. Kucia

*Attorney, Agent, or Firm*—I. Morley Drucker

[57] ABSTRACT

This invention relates to a specific type of multi-conductor cable comprising a plurality of insulated wire conductor pairs, each of said insulated conductor pairs having alternating twist and straight portions and having alignment means for precisely aligning both the twisted portions and straight portions of said insulated conductor pairs in a predetermined, laterally spaced, relationship with respect to each other. The alignment means of the multi-conductor calbe of this invention comprises a laminated plastic sheet, initially formed from first and second plastic sheets or films, the laminated film having (a) a plurality of precisely spaced encapsulating ducts formed therein, each encapsulating duct containing either an individual, insulated, straight portion of a conductor or an insulated conductor twisted pair and (b) nip areas extending laterally between, and joining, each of said precisely spaced encapsulating ducts.

The precisely spaced intermittent straight portions provide easy, mass termination sites and do not appreciably affect the electrical characteristics of the multi-conductor cable.

1 Claim, 5 Drawing Figures

TWISTED PAIR MULTI-CONDUCTOR RIBBON CABLE WITH INTERMITTENT STRAIGHT SECTIONS

CROSS-REFERENCE TO RELATED APPLICATIONS

This application is also a continuation of application Ser. No. 885,440, filed Mar. 10, 1978, now abandoned, said Ser. No. 885,440 being a division of patent application Ser. No. 725,539, filed Sept. 22, 1976, and entitled: "METHOD AND APPARATUS FOR MAKING TWISTED PAIR MULTI-CONDUCTOR RIBBON CABLE WITH INTERMITTENT STRAIGHT SECTIONS" now U.S. Pat. No. 4,096,006 issued Jun. 20, 1978.

This application is related to patent application Ser. No. 545,582 entitled "TWISTED PAIR MULTI-CONDUCTOR RIBBON CABLE WITH INTERMITTENT STRAIGHT SECTIONS" filed Jan. 30, 1975, now U.S. Pat. No. 4,034,148 issued July 5, 1977. Said U.S. Pat. No. 4,034,148 is directed, basically, to a multi-conductor twisted pair cable having intermittent straight sections while this application is directed primarily to improvements in such cables. U.S. Pat. No. 4,034,148 is owned by the same assignee as is the instant application.

BACKGROUND OF THE INVENTION

It has become increasingly important to accurately space insulated multiple bands of conductors with respect to each other and laminated flat ribbon cable has increasingly come into use for this purpose. Precise control of electrical characteristics such as impedance, capacitance, cross talk and attentuation, especially important in digital data, and signal, transmission may be thereby achieved. Both controlled regular spacing and controlled irregular spacing, of multiple conductors in ribbon cable form has been achieved, in the prior art, by laminating the accurately spaced insulated (or uninsulated) multiple conductors between thin plastic film, such as 5 mil polyvinyl chloride (pvc) film or 5 mil Teflon* film.

*Teflon is a registered trademark of E. I. duPont de Nemours, Wilmington, Delaware Multiple pairs of insulated conductors have also been accurately laterally spaced, in ribbon cable, by laminating multiple pairs of insulated twisted conductor pairs between thin plastic sheet or film, the twisted pairs being first laid onto a first plastic film and encapsulated and accurately oriented by a second plastic film laminated to the first film. The use of twisted pairs of multi-conductor cable is of great importance in the field of communications, data processing and other applications where cross-talk in signal transmission must be kept to a minimum. The laminated, twisted pair, multi-conductor ribbon cable of the prior art has, however, one material drawback, namely the present, standard, terminating techniques require that after the twisted pairs which are to be terminated have been separated from the laminate, the ends of each pair must then be untwisted manually, or with the aid of a special pliers or other tools. The separation procedure is time consuming and becomes impractical when dealing with large amounts of termination points or when it may be preferred to terminate the ends of such multi-conductor laminated ribbon cable onto an Insulation Displacement Connector (IDC) or other mass termination device for an IDC or the like requires great accuracy in the spacing of the ends of the multi-conductor cable which are to be mass-terminated thereon.

The invention is therefore directed to an improved laminated multi-conductor ribbon cable, having a plurality of twisted insulated conductor pairs in combination with intermittent straight sections laminated therein at precise lateral spacings which overcomes the just-mentioned time-consuming problem of untwisting the cable for termination purposes, while at the same time, more precisely orienting the termination points of the conductors for connection to IDC connectors, and the like.

The applicants are aware of U.S. Pat. No. 3,579,823 entitled "APPARATUS AND METHOD FOR APPLYING INDEXING STRIPS TO CABLE PAIR GROUPS" and issued to T. J. Gressit on May 25, 1971. This patent relates to a method and apparatus for the manufacture of multi-pairs of twisted cable. The twisted multi-pairs have compliant plastic strips placed at periodic straightened intervals in the twisted pairs for the purpose of maintaining the lateral spacing, at the straight intervals, between the conductor pairs.

It is a major object of this invention, however, to more positively achieve a precise, lateral spacing of both twisted pair portions and the intermittent straight conductor portions of the multi-conductor cable pairs, so that mass termination of the straight portions can be reliably achieved, as well as realizing other processing advantages. The method and apparatus, by which this may be accomplished, is set forth in said earlier mentioned U.S. Pat. No. 4,096,006.

SUMMARY OF THE INVENTION

This invention is directed to a laminated, multi-conductor ribbon cable having a first laminating plastic film on which is placed a plurality of pairs of insulated conductors, each of said pairs of insulated conductors having alternating twisted portions and straight portions, and a second laminating plastic film which encapsulates and orients the plurality of insulated conductor portions along a precise predetermined, lateral spacing.

The first and second plastic films are preferably heat welded or heat sealed under pressure, to each other, in the nip areas on either side of the conductors, and the films may also be heat welded to the insulation of the conductor portions themselves in order to further anchor the individual conductors or conductor pairs, with respect to adjacent individual conductors or conductor pairs.

Mass termination of the cable occurs by simply transversely slitting the cable within a straight cable portion, and mass terminating the conductor ends onto an IDC, or other connector, having mass termination contacts spaced equally to that of the spacing between the straight portions of adjacent conductors.

The resulting multi-conductor ribbon cable of this invention may be briefly described as one which comprises:

a plurality of insulated wire conductor pairs, each of said insulated conductor pairs having alternating twisted portions and straight portions; and alignment means for aligning said insulated conductor pairs in a predetermined spaced relationship with respect to each other, the alignment means comprising a laminated plastic film having a plurality of spaced encapsulating ducts formed therein, each encapsulating duct containing either an individual straight conductor portion or an insulated conductor twisted pair portion and having nip areas extending laterally between, and joining, each of said spaced encapsulating ducts.

DETAILED DESCRIPTION OF THE INVENTION

Figure 1:
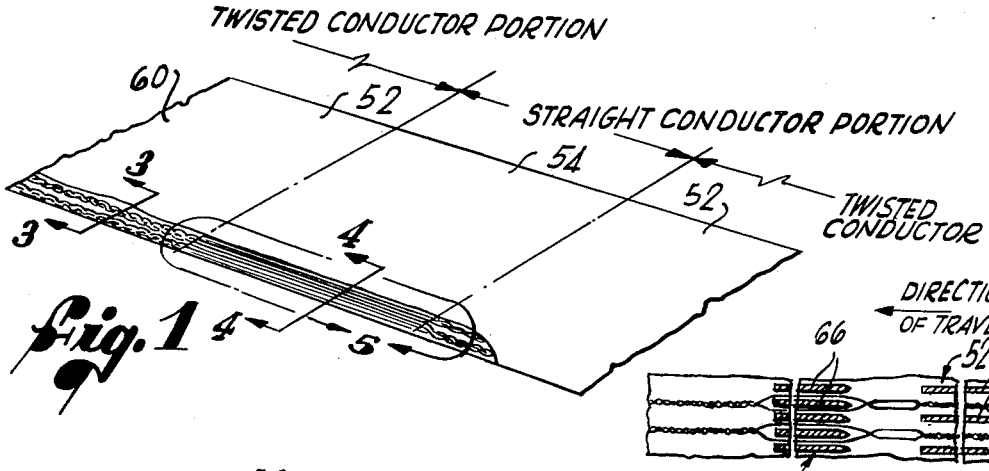
FIG. 1 is a black diagram indicating the main process and apparatus stations employed in this invention.

Referring now to FIG. 1, an overview of the various process and apparatus stations utilized to make the cable of this invention will first be set forth. Individual insulated conductors, designated by the number 20, are unwound from a series of spools 22 (shown diagrammatically only), passed through a plurality of twister tubes in a twister zone 23, thence through a straightening and aligning zone or station 26, and into a laminating zone or station 28. Plastic laminating sheets 60, 62 are also fed into the laminating section 28 (from upper and lower film spools 30, 31 respectively) to encapsulate both the twisted portions of the cable and the alternating straight portions, which are then laminated under heat and pressure, to produce thereby a hot laminated multi-conductor cable having laterally aligned alternating twisted and straight sections.

The thus formed cable 50 may then be passed through an imprinting section (for affixation of codings, trademarks, or other markings) if desired, and thence to a cooling section 34, for cooling, before being wound onto take-up spools (not shown) in a conventional manner. A constant-speed motor, of conventional design, (not shown) is employed to pull the cable through the various stations, just outlined, under a constant and predetermined tension.

The thus formed cable 50 is shown particularly in FIGS. 2–5. The alternating twist portions and straight portions of the cable 50 are designated generally by the numerals 52, 54, respectively.

Figure 4:
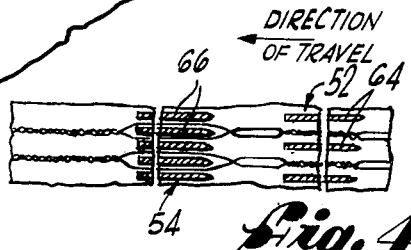
FIG. 4 is a partial cross-sectional view of the cable taken along the line 4—4 of FIG. 2.
Figure 2:
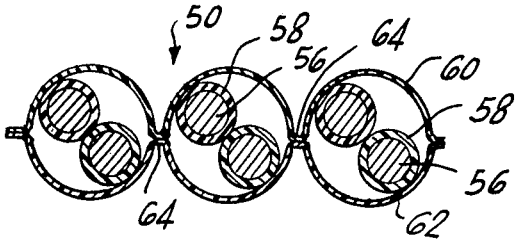
FIG. 2 is a perspective view of a multi-conductor cable formed by the method and apparatus of this invention, in which a portion of the cable is shown with the upper plastic laminating sheet partially removed to reveal the alternating twist and straight portions of the aligned insulated conductors.
Figure 3:
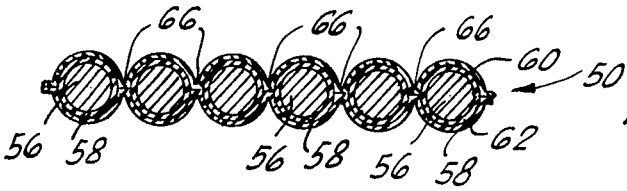
FIG. 3 is a partial cross-sectional view of the cable taken along the line 3—3 of FIG. 2.
Figure 2:
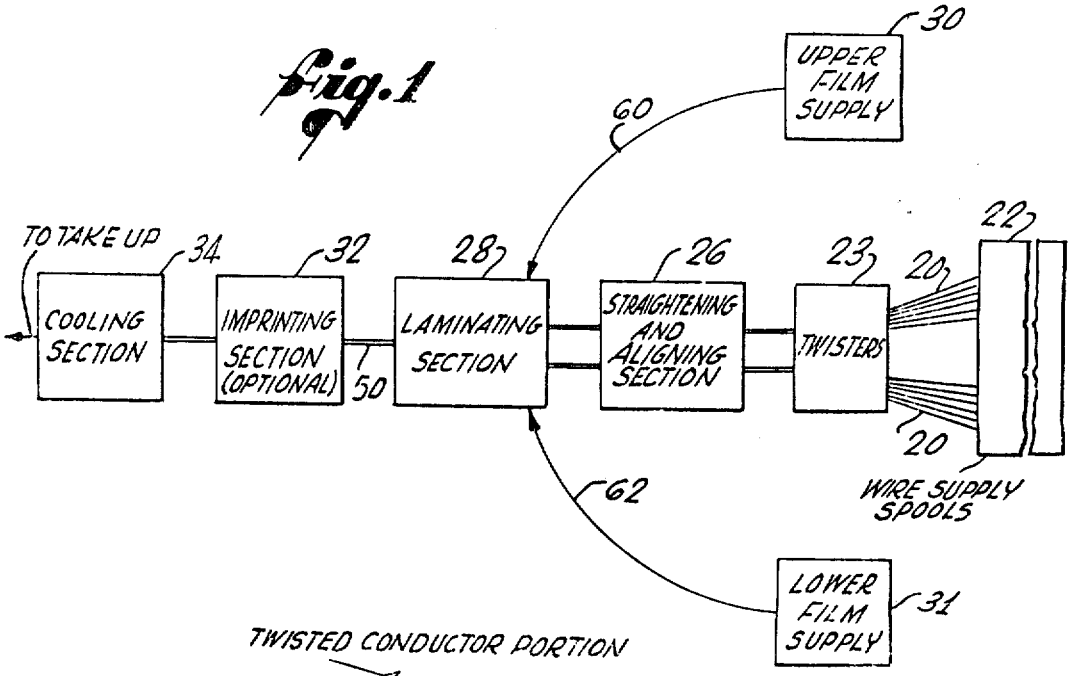
Figure 2:
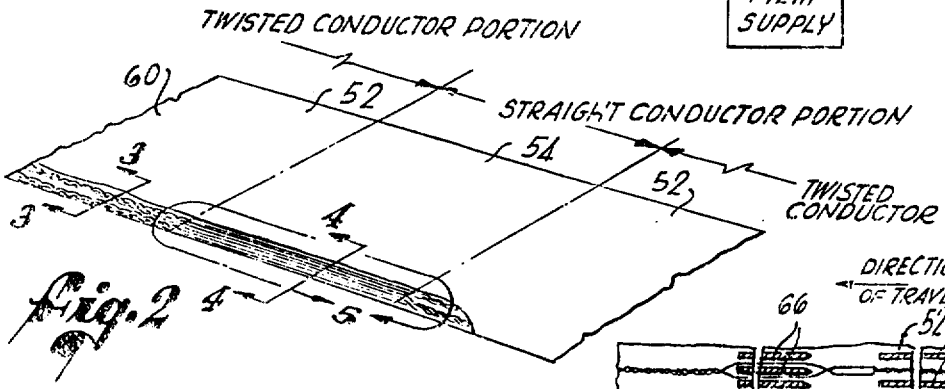

Referring particularly to FIGS. 3 and 4, each of the individual insulated conductors 20 employed in this invention, preferably comprise a central metal conductor 56, e.g., of copper or aluminum with a preferably round polyvinyl chloride (pvc) or other plastic insulation 58 formed therearound. The wire gauge and insulation thickness may be varied within wide limits which are well known in the art.

The first (upper) and second (lower) laminating plastic sheets or film of the cable 50 designated by the numerals 60, 62, respectively, may be made of pvc or Teflon, or other pliable, heat sealable plastic film. The thickness of the film may vary within wide limits, e.g., of the order of 4–12 mils, although other thicknesses may also be employed depending upon the application of the finished cable 50.

Figure 5:
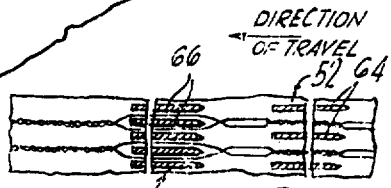
FIG. 5 is an enlarged plan view of the portion of the multi-conductor cable shown by the arcuate arrow designated 5—5 of FIG. 2.
Figure 3:
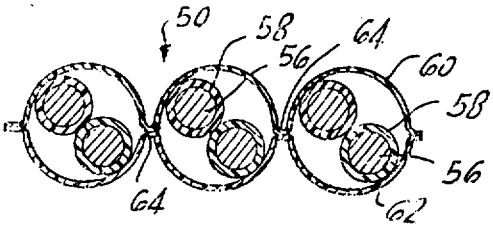
Figure 4:
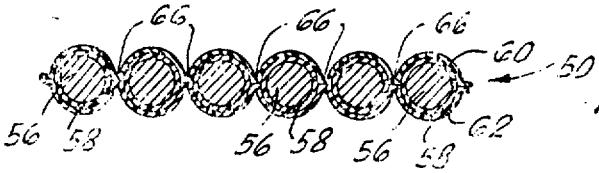

The upper and lower laminated films 60, 62 constitute the alignment means for both the twisted pair portions 52 and straight portions 54 of the cable 50. This alignment is formed, during processing, by forming encapsulating ducts or channels which contain individual straight conductor portions alternating with twisted pair portions, each of these portions being precisely laterally spaced by means of heat-welded nip areas extending laterally between and joining each of the said encapsulating ducts. The welded nip areas in the twisted portion of the cable 20 are designated by the numeral 64, and in the straight portion of the cable by the numeral 66, as best shown in FIGS. 3–5.

The various apparatus and process steps have been described in detail in U.S. Pat. No. 4,096,006.

We intend to be limited only by the claims which follow.

We claim:

1. A laminated multi-conductor cable, which comprises:

a plurality of laterally spaced, elongated, insulated conductor pairs, each of said insulated conductor pairs having twisted portions alternating, in the longitudinal direction, with individual straight portions, said plurality of said laterally spaced insulated conductor pairs being arranged to form a plurality of laterally spaced and laterally aligned twisted portions alternating with a plurality of laterally equidistantly spaced and laterally aligned individual straight portions;

a first continuously extending laminating plastic film underlying said laterally spaced insulated conductor pairs; and a second continuously extending laminating plastic film overlying said laterally spaced insulated conductor pairs and being laminated to said first plastic film at nip areas extending laterally between each of said laterally spaced and laterally aligned twisted portions and between each of the individual conductors of each of said laterally equidistantly spaced and laterally aligned individual straight portions, said first and second laminated films tightly surrounding each of said twisted portions and each of the individual conductors of each of said individual straight portions and forming longitudinally extending encapsulating ducts for each of said twisted portions and for each of the individual conductors of each of said individual straight portions to thereby precisely space each of said twisted portions and equidistantly space each of the individual conductors of each of said individual straight portions along their entire lengths within said laminated cable.

* * * * *

UNITED STATES PATENT OFFICE
CERTIFICATE OF CORRECTION

PATENT NO. : 4,359,597 Page 1 of 2

DATED : November 16, 1982

INVENTOR(S) : PATRICK J. PAQUIN, DONALD D. LANG

It is certified that error appears in the above-identified patent and that said Letters Patent are hereby corrected as shown below:

In the Abstract - Line 9, "calbe" should be --cable--;

In Column 3 - Line 6, "black" should be --block--; and

In the drawings, substitute FIGURES 1-5 attached for FIGURES 1-4 .

Signed and Sealed this

*Tenth* Day of *May 1983*

[SEAL]

*Attest:*

GERALD J. MOSSINGHOFF

*Attesting Officer* *Commissioner of Patents and Trademarks*